United States Patent [19]

Seki et al.

[11] Patent Number: 4,871,635

[45] Date of Patent: Oct. 3, 1989

[54] ELECTROPHOTOGRAPHIC PHOTOCONDUCTOR LAYERED ELEMENT COMPRISING SALT MATERIAL UNDERCOAT LAYER ON CONDUCTIVE SUPPORT

[75] Inventors: Kenji Seki, Mishima; Junichiroh Hashimoto, Numazu; Michio Kimura, Numazu; Hirofumi Yamanami, Namazu; Satomi Mochizuki, Numazu; Izumi Aiso, Numazu, all of Japan

[73] Assignee: Ricoh Company, Ltd., Tokyo, Japan

[21] Appl. No.: 193,538

[22] Filed: May 13, 1988

Related U.S. Application Data

[63] Continuation-in-part of Ser. No. 51,757, May 20, 1987, and Ser. No. 49,300, May 13, 1987, abandoned.

[30] Foreign Application Priority Data

May 20, 1986 [JP] Japan ..... 61-115762

[51] Int. Cl.[4] ..... G03G 5/10

[52] U.S. Cl. ..... 430/60; 430/69

[58] Field of Search ..... 430/60, 61, 62, 63, 430/64, 65, 69

[56] References Cited

U.S. PATENT DOCUMENTS 3,276,868 10/1966 Uhlig ..... 430/60

*Primary Examiner*—J. David Welsh

*Attorney, Agent, or Firm*—Oblon, Spivak, McClelland, Maier & Neustadt

[57] ABSTRACT

A repeatedly usable electrophotographic photoconductor comprising (a) an electroconductive support, (b) an undercoat layer containing therein at least one salt selected from the group consisting of carboxylates, amino carboxylates, phosphates, polyphosphates, phosphites, phosphate derivatives, borates, sulfates and sulfites, and (c) a photoconductive layer, which layers are successively overlaid on the electroconductive support.

29 Claims, 1 Drawing Sheet

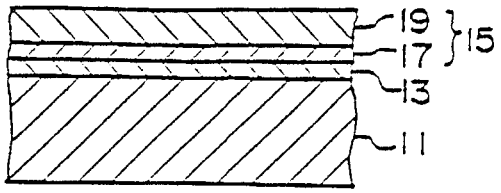
19
17
15
13
11

ELECTROPHOTOGRAPHIC PHOTOCONDUCTOR LAYERED ELEMENT COMPRISING SALT MATERIAL UNDERCOAT LAYER ON CONDUCTIVE SUPPORT

This application is a continuation-in-part of application Ser. No. 07/051,757, filed May 20, 1987, and application 07/049,300, filed May 13, 1987 (now abandoned).

BACKGROUND OF THE INVENTION

The present invention relates to an electrophotographic photoconductor, which can be employed in repetition, and comprises (a) an electroconductive support, (b) an undercoat layer containing therein at least one salt selected from the group consisting of carboxylates, amino carboxylates, phosphates, polyphosphates, phosphites, phosphate derivatives, borates, sulfates and sulfites, and (c) a photoconductive layer, which layers are successively overlaid on the electroconductive support.

Electrophotographic photoconductors are widely employed, for instance, in conventional plain paper copying machine, laser printers and digital copying machines. When an organic photoconductor is employed as such electro-photographic photoconductor, an undercoat layer consisting of a resin having a relatively low electric resistivity is usually interposed between a photoconductive layer and an electroconductive support in order to improve the charge-ability of the photoconductive layer and the adhesion of the photoconductive layer to the support.

As such resins for use in the undercoat layer, for instance, the following resins are proposed: Polyamide resin (Japanese Laid-Open Patent Application Nos. 58-30757 and 58-98739), an alcohol-soluble nylon resin (Japanese Laid-Open Patent Application No. 60-196766), and a water-soluble polyvinyl butyral resin (Japanese Laid-Open Patent No. Application 60-232553).

However, the above resins, when used in the undercoat layer, have the shortcomings that their resistivities increase at low humidities, and the residual potential of the electrophotographic photoconductor increases during the repeated use thereof, so that the image quality obtained is significantly degraded.

In order to prevent the degradation of the image formation characteristics of the electrophotographic photo-conductor while in use, it is proposed to form an undercoat layer comprising a polyamide resin and an electro-conductive polymer in Japanese Laid-Open Patent Application No. 58-95744. This method, however, has the shortcoming that the undercoat layer decreases the photosensitivity of the photoconductor. Further it is proposed to provide an electroconductive pigment in the undercoat layer in Japanese Laid-Open Patent Application No. 58-93063. This method has the shortcoming that the undercoat layer decreases the chargeability of the photoconductor.

SUMMARY OF THE INVENTION

It is therefore an object of the present invention to provide an electrophotographic photoconductor, for which the image formation characteristics are not degraded by the changes in the ambient humidity, and which can be employed in repetition.

The above object of the present invention is achieved by an electrophotographic photoconductor comprising (a) an electroconductive support, (b) an undercoat layer containing therein at least one salt selected from the group consisting of carboxylates, amino carboxylates, phosphates, polyphosphates, phosphites, phosphate derivatives, borates, sulfates and sulfites, and (c) a photoconductive layer, which layers are successively overlaid on the electro-conductive support.

BRIEF DESCRIPTION OF THE DRAWING

In the drawing, the single FIGURE shows a schematic cross-sectional view of an electrophotographic photoconductcor according to the present invention.

DETAILED DESCRIPTION OF THE PREFERRED EMBODIMENTS

The accompanying single FIGURE shows a schematic cross-sectional view of an example of an electrophotographic photoconductor according to the present invention, which comprises an electroconductive support 11, an undercoat layer 13 formed thereon and a photoconductive layer 15 overlaid on the undercoat layer 13.

The undercoat layer 13 comprises a binder resin and a salt dispersed in the resin, which salt is selected from the group consisting of carboxylates, amino carboxylates, phosphates, polyphosphates, phosphites, phosphate derivatives, borates, sulfates and sulfites.

Examples of a carboxylate are (i) aromatic hydrocarbon carboxylates, such as salts of salicylic acid, phthalic acid, benzoic acid, pyromellitic acid, p-phenylbenzoic acid, nitrobenzoic acid, 1-naphtalenecarboxylic acids such as 1-naphthaleneacetic acid, 9-anthracenecarboxylic acid, and (ii) aliphatic hydrocarbon carboxylates, such as salts of acetic acid, adipic acid, stearic acid, 2-ethylhexanoic acid, oleic acid, citric acid, crotonic acid, succinic acid, tartaric acid, sebacic acid, n-decanoic acid, pyruvic acid, palaitic acid, fumaric acid, and acetylenedicarboxylic acid.

Examples of an amino carboxylate are salts of glycine, amino hexanoic acid, glycylglycine, aminohipuric acid, 4-amino salicylic acid, p-aminobenzoic acid, and ethylene-diamine-tetraacetic acid.

An examples of phosphate is a salt of orthophosphoric acid, and examples of a polyphosphate are salts of a polyphosphoric acid such as triphosphoric acid, trimetaphosphoric acid, tetrametaphosphoric acid, metaphosphoric acid, and pyrophosphric acid.

Examples of a phosphorate derivative are salts of 1-naphthyl-phosphoric acid, and carbamyl phosphate.

Examples of a phosphite are salts of hypophosphorous acid, orthophophorous acid, metaphophorous acid, and pyrophosphorous acid.

Examples of a borate are salts of boric acid and metaboric acid.

Examples of a sulfate are salts of sulfuric acid, pyrosulfuric acid and thiosulfuric acid.

Examples of a sulfite are salts of sulfurous acid and pyrosulfurous acid.

The above salts are alkali metal salts, such as lithium, potassium and sodium salts, and ammonium salts.

These salts can be used individually or in combination in the undercoat layer.

As a binder resin for use in the undercoat layer, any conventional resins can be employed. However since the photoconductive layer 15 is coated on the undercoat layer by using a solvent, it is preferable that the resin for use in the undercoat layer be resistant to organic solvents in general use. Specific examples of such binder resin for use in the undercoat layer are a water-soluble resin such as polyvinyl alcohol, casein and sodium polyacrylate; an alcohol-soluble resin such as copolymer nylon and methoxymethylated nylon; a setting-type resin forming a three-dimensional network, such as polyurethane, melamine resin, and epoxy resin.

It is preferable that the amount of the previously mentioned salt be in the range of 0.1 to 50 parts by weight, more preferably 0.3 to 20 parts by weight, to 100 parts of the above-mentioned resin.

In order to prevent the moire in the undercoat layer, which may be caused by the interference by the multiple reflections of the incident light to the photoconductor, a white pigment, such as titanium dioxide, zinc sulfide, zinc oxide and white lead, can be contained in the undercoat layer.

It is preferable that the thickness of the undercoat layer be in the range of about 0.2 to about 50 μm, more preferably in the range of 1 to 30 μm.

The present invention is particularly directed to the improvement of the undercoat layer. Therefore there are no particular limitations on the choice of the electro-conductive support and/or the photoconductive layer for use in the present invention.

A representative electrophotographic photoconductor according to the present invention will now be given for illustration of the present invention, without intending to be limiting thereof, with reference to the accompanying drawing.

The photoconductive layer 15 comprises a charge generating layer 17 and a charge transporting layer 19 which is overlaid on the charge generating layer 17. The charge generating layer 17 comprises a charge generating material and a binder resin in which the charge generating material is uniformly dispersed.

As the binder resin, condensation resins such as polyamide, polyurethane, polyester, epoxy resin, polyketone and polycarbonate; and vinyl polymers such as polyvinyl ketone, polystyrene, poly-N-vinylcarbazole, polyacrylamide, and polyvinyl butyral, can be employed.

As the charge generating material, the following can be employed in the present invention: Organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment having a porphyrin skeleton; an azulenium salt pigment; a squaric pigment; an azo pigment having a carbazole skeleton (Japanese Laid-Open Patent Application No. 53-95033), an azo dye having a styrylstilbine skeleton (Japanese Laid-Open Patent Application No. 53-138229), an azo pigment having a triphenylamine skeleton (Japanese Laid-Open Patent Application No. 53-132547), an azo pigment having a dibenzothiophene skeleton (Japanese Laid-Open Patent Application No. 54-21728), an azo pigment having an oxazole skeleton (Japanese Laid-Open Patent Application No. 54-12742), an azo pigment having a fluorenone skeleton (Japanese Laid-Open Patent Application No. 54-22834), an azo pigment having a bisstilbene skeleton (Japanese Laid-Open Patent Application No. 54-17733), an azo pigment having a distyryl oxadiazole skeleton (Japanese Laid-Open Patent Application No. 54-2129), an azo pigment having a distyryl carbazole skeleton (Japanese Laid-Open Patent Application No. 54-17734), a trisazo pigment having a carbazole skeleton (Japanese Laid-Open Patent Applications Nos. 57-195767 and 57-195768); a phthalocyanine-type pigment such as C.I. Pigment Blue 16 (C.I. 74100); Indigo-type pigments such as C.I. Vat Brown 5 (C.I. 73410) and C.I. Vat Dye (C.I. 73030); and perylene-type pigments such as Indanthrene Scarlet R (made by Bayer Co., Ltd); and inorganic pigments, such as selenium, selenium alloys, cadmium sulfide, and amorphous silicon.

In the charge generating layer, it is preferable that the previously mentioned binder resins be employed in an amount ranging from 5 parts by weight to 100 parts by weight, more preferably in an amount ranging from 10 parts by weight to 50 parts by weight, to 100 parts by weight of the above-mentioned charge generating material.

It is preferable that the thickness of the charge generating layer 17 be in the range of about 0.05 to about 1 μm, more preferably in the range of 0.1 to 0.5 μm.

The charge transporting layer 19 can be formed by coating a charge transporting layer coating liquid on the charge generating layer 17 and then drying the coated liquid, which charge transporting layer is prepared by dissolving or dispersing a charge transporting material and a binder agent in an organic solvent. When necessary, a plasticizer and a leveling agent can be added to the coating liquid.

As the charge transporting material, for example, the following electron donor materials can be employed in the present invention: poly-N-vinylcarbazole and derivatives thereof, poly-y-carbazolyl ethyl glutamate and derivatives thereof, pyrene-formaldehyde condensate and derivatives thereof, polyvinyl pyrene, polyvinyl phenantrene, oxazole derivatives, oxadiazole derivatives, iaidazole derivatives, triphenylamine derivatives, 9-(p-diethylaminostyryl) anthracene, 1,1-bis-(4-dibenzylaminophenyl) propane, styryl anthracene, styryl pyrazoline, phenylhydrazone, and α-phenylstilbene derivatives.

As the binder resin for the charge transporting layer 19, for example, the following thermoplastic and thermosetting resins can be employed: polystyrene, styrene acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinylformal, polyvinyl toluene, poly-N-vinylcarbazole, acrylic resin, silicone resin, epoxy resin, melamine resin, urethane resin, phenolic resin, and alkyd resin.

It is preferable that the thickness of the charge transporting layer 19 be in the range of about 5 to about 100 μm.

As the electroconductive support 11, there can be employed, for example, (i) a plastic film deposited with a metal or a metal oxide, such as aluminum, nickel, chrome, nichrome, copper, tin oxide, and indium oxide, by vacuum vapor deposition; (ii) a plastic drum deposited with a metal or a metal oxide, such as aluminum, nickel, chrome, nichrome, copper, tin oxide, and indium oxide, by vacuum vapor deposition; (iii) a metal plate made of aluminum, nickel or stainless steel; (iv) a metal drum made by working the above-mentioned metal plate into a drum by Drawing and Ironing (D.I.), Impact Extrusion and Ironing (I.I.), extrusion, or drawing, and cutting the drum, following by treating the surface thereof by superfinishing or polishing; (v) a plastic film containing an electroconductive material; (vi) a plastic drum containing an electroconductive material; (vii) a plastic film having a coated thereon an electroconductive resinous layer containing an electroconductive material; (viii) a plastic film having a coated thereon an electroconductive resinous layer containing an electroconductive material; and (ix) a metal drum having coated thereon an electronductive resinous layer containing an electroconductive material.

As the electroconductive material for use in the electroconductive support, carbon black and metal oxides such as $In_2O_3$, $Sb_2O_3$, $SnO_2$, $TiO_2$, and ZnO, and finely-divided particles of a metal such as Al, Sn, In and Ti, can be employed.

Furthermore, the plastic film may be made of, for example, phenol resin, melamine resin, polyimide resin, and polyester, and the plastic drum may be made of, for example, phenol resin, melamine resin and polyimide resin.

As the resins for use in the electroconductive resinous layer, a hardening resin such as alykyd resin, melamine resin, epoxy resin and urethane resin; a water-soluble resin such as polyvinyl alcohol and casein; and an alcohol-soluble resin such as nylon copolymer and methoxymethylated nylon can be employed.

The above-mentioned electrophotographic photoconductor according to the present invention can be modified, for example, by disposing an insulating layer on the photo-conductive layer or by forming a single photoconductive layer instead of the above-mentioned double-layered photoconductive layer.

Specific examples of an electrophotographic photoconductor according to the present invention will now be explained in detail.

EXAMPLE 1

10 g of an alcohol-soluble nylon copolymer (Trademark "Amilan CM-4000" made by Toray Industries, Inc.) was dissolved in 100 g of methanol. To this solution, 0.4 g of ammonium benzoate was added. The mixture was dispersed in a ball mill for 5 hours, whereby an undercoat layer coating liquid was prepared.

An aluminum plate having a thickness of 0.2 mm was immersed into the above prepared undercoat layer coating liquid, so that the undercoat layer coating liquid was coated on the aluminum plate. The coated liquid was then dried at 120° C. for 5 minutes, whereby an undercoat layer was formed with a thickness of about 2 μm on the aluminum plate.

5 g of a polyester resin (Trademark "Vylon 200" made by Toyobo Co., Ltd.) was dissolved in 150 g of tetrahydrofuran. To this solution, 10 g of a bisazo pigment having the following formula was added.

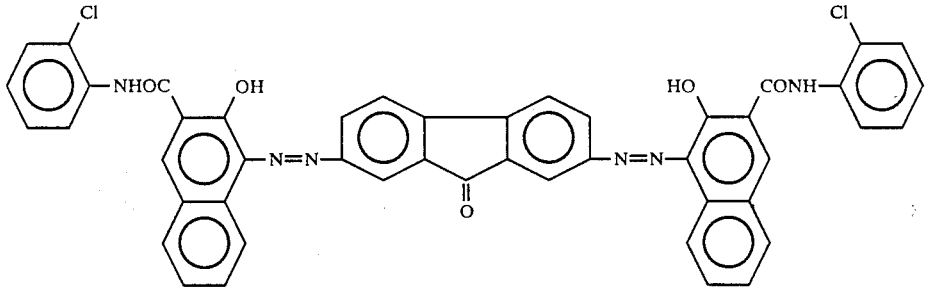

The mixture was dispersed in a ball mill for 24 hours. Thereafter, the dispersion was placed in a container and was then diluted with tetrahydrofuran, with stirring, so that the amount of the solid components in the dispersion was adjusted to be 1 wt.%, whereby a charge generating layer coating liquid was prepared.

The thus prepared charge generating layer coating liquid was coated on the undercoat layer by immersing the undercoat layer into the charge generating layer coating liquid, and was then dried at 120° C. for 5 minutes, whereby a charge generating layer was formed with a thickness of 0.3 μm on the undercoat layer.

12 g of a polycarbonate resin (Trademark "Panlite K-1300" made by Teijin Limited) was dissolved in 90 g of tetrahydrofuran. In this solution, 8 g of a charge transporting material having the following formula and 2 mg of silicone oil (Trademark "Silicone Oil KF-50" made by Shin-Etsu Chemical Co., Ltd.) were dissolved, whereby a charge transporting layer coating liquid was prepared:

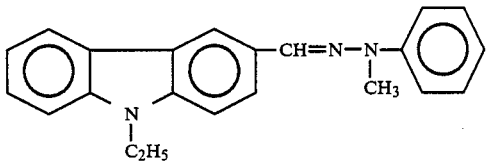

The thus prepared charge transporting layer coating liquid was coated on the charge generating layer by immersing the charge generating layer into the charge transporting coating liquid, and was then dried at 120° C. for 15 minutes, whereby a charge transporting layer was formed with a thickness of 18 μm on the charge generating layer.

Thus, an electrophotographic photoconductor No. 1 according to the present invention was prepared.

COMPARATIVE EXAMPLE 1

Example 1 was repeated except that ammonium benzoate was eliminated from the formulation of the undercoat layer coating liquid, whereby a comparative electrophotographic photoconductor No. 1 was prepared.

EXAMPLE 2

A mixture of 10 g of milk casein, 100 g of water and 0.5 ml of concentrated ammonia water was heated to 70° C. with stirring, so that the milk casein was dissolved in the mixture. To this solution, 0.5 g of sodium borate was added and dissolved therein, whereby an undercoat layer coating liquid was prepared.

An aluminum plate having a thickness of 0.2 mm was then immersed into the thus prepared undercoat layer coating liquid, so that the undercoat layer coating liquid was coated on the aluminum plate. The coated liquid was then dried at 110° C. for 5 minutes, whereby an undercoat layer was formed with a thickness of about 1.5 μm on the aluminum plate.

5 g of a butyral resin (Trademark "S-LEC BL-S" made by Sekisui Chemical Co., Ltd.) was dissolved in 150 g of cyclohexanone. To this solution, 10 g of a trisazo pigment having the following formula was added:

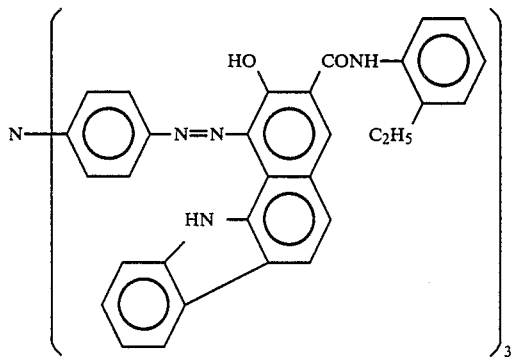

The mixture was dispersed in a ball mill for 3 hours. Thereafter, the dispersion was placed in a container and was then diluted with cyclohexanone, with stirring, so that the relative amount of the solid components in the dispersion was adjusted to be 1.5 wt.%, whereby a charge generating layer coating liquid was prepared.

The thus prepared charge generating layer coating liquid was coated on the undercoat layer by immersing the undercoat layer into the charge generating layer coating liquid, and was then dried at 120° C. for 5 minutes, whereby a charge generating layer was formed with a thickness of 0.2 μm on the undercoat layer.

The same charge transporting layer coating liquid as that employed in Example 1 was coated on the charge generating layer, and was then dried at 120° C. for 15 minutes, whereby a charge transporting layer was formed with a thickness of 18 μm on the charge generating layer Thus, an electrophotographic photoconductor No. 2 according to the present invention was prepared.

COMPARATIVE EXAMPLE 2

Example 2 was repeated except that the sodium borate employed in Example 2 was eliminated from the formulation of the undercoat layer coating liquid, whereby a comparative electrophotographic photoconductor No. 2 was prepared.

EXAMPLE 3

To 50 g of acryl polyol (Trademark "Thermolac U-230A" made by Soken Chemical Co., Ltd.), 150 g of methyl ethyl ketone, 0.3 g of potassium sulfate, and 25 g of titanium oxide powder (Trademark "Tipaque R 780" made by Ishihara Sangyo Kaisha, Ltd.) were added. The mixture was dispersed in a ball mill for 12 hours. To this mixture, 30 g of isocyanate (Trademark "Coronate HL" made by Nippon Polyurethane Industry Co., Ltd.) was added, and the mixture was dispersed for 30 minutes, whereby an undercoat layer coating liquid was prepared.

An aluminum plate having a thickness of 0.2 mm was then immersed into the thus prepared undercoat layer coating liquid, so that the undercoat layer coating liquid was coated on the aluminum plate. The coated liquid was then dried and hardened at 100° C. for 60 minutes, whereby an undercoat layer was formed with a thickness of about 3 μm on the aluminum plate.

The same charge generating layer coating liquid as that employed in Example 1 was coated on the undercoat layer by immersing the undercoat layer into the charge generating layer coating liquid, and was then dried at 120° C. for 5 minutes, whereby a charge generating layer was formed with a thickness of 0.2 μm on the undercoat layer.

12 g of a polycarbonate resin (Trademark "Panlite K-1300" made by Teijin Limited) was dissolved in 90 g of tetrahydrofuran. In this solution, 8 g of a charge transporting material having the following formula and 2 mg of silicone oil (Trademark "Silicone Oil KF-50" made by Shin-Etsu Chemical Co., Ltd.) were dissolved, whereby a charge transporting layer coating liquid was prepared:

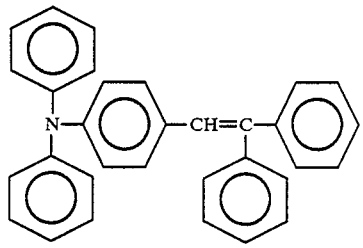

The thus prepared charge transporting layer coating liquid was coated on the charge generating layer by immersing the charge generating layer into the charge transporting coating liquid, and was then dried at 120° C. for 15 minutes, whereby a charge transporting layer was formed with a thickness of 20 μm on the charge generating layer.

Thus, an electrophotographic photoconductor No. 3 according to the present invention was prepared.

COMPARATIVE EXAMPLE 3

Example 3 was repeated except that the potassium sulfate employed in Example 3 was eliminated from the formulation of the undercoat layer coating liquid, whereby a comparative electrophotographic photoconductor No. 3 was prepared.

EXAMPLE 4

10 g of an alcohol-soluble nylon (Trademark "Diamide X-1874" made by Daicel Chemical Co., Ltd.) was dissolved in 100 g of methanol. To this solution, 0.5 g of lithium phosphate and 10 g of titanium oxide (Trademark "Tipaque W-10" made by Ishihara Sangyo Kaisha, Ltd.) were added, and the mixture was dispersed in a ball mill for 12 hours, whereby an undercoat layer coating liquid was prepared.

An aluminum plate having a thickness of 0.2 mm was then immersed into the thus prepared undercoat layer coating liquid, so that the undercoat layer coating liquid was coated on the aluminum plate. The coated liquid was then dried at 120° C. for 5 minutes, whereby an undercoat layer was formed with a thickness of about 3 μm on the aluminum plate.

The same charge generating layer coating liquid as that employed in Example 2 was coated on the undercoat layer by immersing the undercoat layer into the charge generating layer coating liquid, and was then dried at 120° C. for 5 minutes, whereby a charge generating layer was formed with a thickness of 0.2 μm on the undercoat layer.

12 g of a polycarbonate resin (Trademark "Panlite-1300" made by Teijin Limited) was dissolved in 90 g of tetrahydrofuran. In this solution, 7 g of a charge transporting material having the following formula was dissolved, whereby a charge transporting layer coating liquid was prepared:

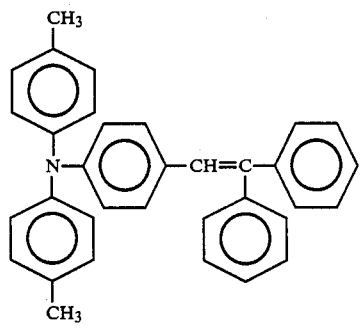

The thus prepared charge transporting layer coating liquid was coated on the charge generating layer by immersing the charge generating layer into the charge transporting coating liquid, and was then dried at 120° C. for minutes, whereby a charge transporting layer was formed with a thickness of 20 μm on the charge generating layer.

Thus, an electrophotographic photoconductor No. 4 according to the present invention was prepared.

COMPARATIVE EXAMPLE 4

Example 4 was repeated except that the lithium phosphate employed in Example 4 was eliminated from the formulation of the undercoat layer coating liquid, whereby a comparative electrophotographic photoconductor No. 4 was

EXAMPLE 5

12 g of milk casein, 100 g of water and 0.5 ml of conc. ammonia water were mixed and heated to 70° C., with stirring, so that the the milk casein was dissolved. To this mixture, 1.5 g of carbon black was added. This mixture was then dispersed in a ball mill for 24 hours, whereby an electroconductive layer coating liquid was prepared.

The thus prepared electroconductive layer coating liquid was coated on a polyester film having a thickness of 100 μm and dired at 110° C. for 5 minutes, whereby an electroconductive layer with a thickness of 7 μm on dry basis was formed. Thus, an electroconductive support was prepared.

On this electroconductive support, the same undercoat layer as that employed in Example 4, the same charge generating layer as that employed in Example 2 and the same charge transporting layer as that employed in Example 2 were successively formed in the same fashion as in Example 4, whereby an electrophotographic photoconductor No. 5 according to the present invention was prepared.

COMPARATIVE EXAMPLE 5

Example 5 was repeated except that lithium phosphapte was eliminate from the formulation of the undercoat layer coating liquid employed in Example 5, whereby a comparative electrophotographic photoconductor No. 5 was prepared.

EXAMPLE 6

The same electroconductive layer as that employed in of 0.2 mm, with the maximum surface roughness thereof being 5 μm, whereby an electroconductive support having an electroconductive layer having a thickness of 1.2 μm was formed. The coated deposition of the electroconductive layer was 6 g/m$^2$.

On this electroconductive support, the same undercoat layer as that employed in Example 4, the same charge generating layer as that employed in Example 2 and the same charge transporting layer as that employed in Example 2 were successively formed in the same fashion as in Example 4, whereby an electrophotographic photoconductor No. 6 according to the present invention was prepared.

COMPARATIVE EXAMPLE 6

Example 6 was repeated except that lithium phosphate was eliminated from the formulation of the undercoat layer coating liquid employed in Example 6, whereby a comparative electrophotographic photoconductor No. 6 was prepared.

Each of the thus prepared electrophotographic photo conductors Nos. 1 to 6 according to the present invention and the comparative electrophotographic photoconductors Nos. 1 to 6 was subsequently subjected to the following initial charging, dark decay, and exposure by using Electrostatic Paper Analyzer (Kawaguchi Electro Works, Model SP-428) at a normal humidity (20° C. -65% RH) and at a low humidity (20° C. -15% RH).

First each photoconductor was charged negatively in the dark under application of −6 kV of corona charge for 10 seconds, so that the initial surface potential Vi(V) of the photoconductor was measured.

The photoconductor was then subjected to dark decay by allowing it to stand in the dark for 10 seconds without applying any charge thereto, and the surface potential Vd(V) of the photoconductor after this dark decay was measured.

Finally the photoconductor was illuminated by a tungsten lamp in such a manner that the illuminance on the illuminated surface of the photoconductor was 5 lux for 15 seconds, so that the surface potential $V_e$(V) of the photoconductor after the 15-second exposure was measured. During this exposure, the exposure $E_{1/10}$ (lux sec) required to reduce the initial surface potential $V_i$(V) of the photoconductor to 1/10 of the initial surface potential $V_i$(V) was also measured.

From the above data, the following electrophotographic characteristics of each photoconductor as defined below were assessed.

Charge Retention $= V_d(V)/V_i(V)$

Photosensitivity $= E_{1/10}$ (lux·sec)

Residual Potential $= V_e(V)$

Further, the above-mentioned cycle of initial charging, dark decay, and exposure was continuously repeated for 30 minutes so that each photoconductor was caused to be fatigued. Thereafter, the first mentioned cycle of initial charging, dark decay and exposure was again performed at the normal and low humidities.

The results are shown in the following Table 1.

TABLE 1

| | Initial Characteristics | | | | | | Characteristics after 30 min. Forced Fatigue | | | | | |
|---|---|---|---|---|---|---|---|---|---|---|---|---|
| | Charge Retension | | Photosensitivity (lux · sec) | | Residual Potential (V) | | Charge Retention | | Photosensitivity (lux · sec) | | Residual Potential (V) | |
| | Normal Humidity | Low Humidity | Normal Humidity | Low Humidity | Normal Humidity | Low Humidity | Normal Humidity | Low Humidity | Normal Humidity | Low Humidity | Normal Humidity | Low Humidity |
| Example 1 | 0.89 | 0.91 | 1.73 | 1.74 | 0 | 0 | 0.85 | 0.86 | 1.71 | 1.72 | 2 | 4 |
| Comp. Example 1 | 0.90 | 0.91 | 1.73 | 1.77 | 0 | 6 | 0.82 | 0.84 | 1.74 | * | 5 | 155 |
| Example 2 | 0.83 | 0.86 | 1.56 | 1.57 | 0 | 0 | 0.80 | 0.82 | 1.52 | 1.55 | 3 | 0 |
| Comp. Example 2 | 0.83 | 0.87 | 1.52 | 1.54 | 0 | 5 | 0.78 | 0.81 | 1.51 | * | 12 | 130 |
| Example 3 | 0.92 | 0.93 | 1.89 | 1.90 | 0 | 2 | 0.90 | 0.90 | 1.85 | 1.91 | 5 | 5 |
| Comp. Example 3 | 0.93 | 0.94 | 1.92 | 1.97 | 7 | 15 | 0.88 | 0.85 | 3.56 | * | 45 | 210 |
| Example 4 | 0.88 | 0.90 | 1.41 | 1.42 | 0 | 0 | 0.82 | 0.84 | 1.37 | 1.31 | 1 | 10 |
| Comp. Example 4 | 0.86 | 0.92 | 1.44 | 1.46 | 2 | 8 | 0.80 | 0.81 | 1.39 | * | 3 | 180 |
| Example 5 | 0.84 | 0.87 | 1.39 | 1.40 | 0 | 0 | 0.79 | 0.81 | 1.36 | 1.30 | 1 | 12 |
| Comp. Example 5 | 0.85 | 0.87 | 1.41 | 1.44 | 3 | 7 | 0.77 | 0.80 | 1.40 | * | 6 | 185 |
| Example 6 | 0.87 | 0.89 | 1.41 | 1.42 | 0 | 0 | 0.80 | 0.83 | 1.38 | 1.37 | 1 | 7 |
| Comp. Example 6 | 0.86 | 0.90 | 1.45 | 1.48 | 2 | 6 | 0.79 | 0.81 | 1.47 | * | 4 | 170 |

*measurement impossible

The results shown in the above Table 1 indicate that the electrophotographic photoconductors according to the present invention are excellent in photosensitivity, scarcely affected by the changes in the ambient humidity and significantly less fatigued as compared with the comparative electrophotographic photoconductors.

What is claimed is:

1. In a repeatedly usable electrophotographic photoconductor comprising an electroconductive support, an undercoat layer formed on said electroconductive support, and a photoconductive layer formed on said undercoat layer, the improvement wherein said undercoat layer comprises a binder agent and at least one salt selected from the group consisting of a carboxylate, an amino carboxylate, a phosphate, a polyphosphate, a phosphite, a phosphate derivative, a borate, a sulfate and a sulfite, wherein said electroconductive support comprises a plastic film having deposited thereon a metal or metal oxide layer, or a plastic drum having deposited thereon a metal or metal oxide layer, a metal plate or a metal drum, a plastic film containing an electroconductive material, a plastic drum containing an electroconductive material, a plastic film having coated thereon a resinous layer containing an electroconductive material, a plastic drum having coated thereon a resinous layer containing an electroconductive material, or a metal drum having coated thereon a resinous layer containing an electroconductive material.

2. The electrophotographic photoconductor as claimed in claim 1, wherein said electroconductive material for use in said electroconductive support is carbon black.

3. The electrophotographic photoconductor as claimed in claim 1, wherein said electroconductive material for use in said electroconductive support is a metal oxide.

4. The electrophotographic photoconductor as claimed in claim 1, wherein said electroconductive material for use in said electroconductive support is a metal which is finely divided.

5. The electrophotographic photoconductor as claimed in claim 3, wherein said metal oxide is selected from the group consisting of $In_2O_3$, $Sb_2O_3$, $SnO_2$, $TiO_2$ and ZnO.

6. The electrophotographic photoconductor as claimed in claim 4, wherein said metal is selected from the group consisting of Al, Sn, In, and Ti.

7. The electrophotographic photoconductor as claimed in claim 1, wherein said plastic film comprises a resin selected from the group consisting of phenol resin, malamine resin, polyimide resin, and polyester.

8. The electrophotographic photoconductor as claimed in claim 1, wherein said plastic drum comprises a resin selected from the group consisting of phenol resin, melamine resin and polyimide resin.

9. The electrophotographic photoconductor as claimed in claim 1, wherein said resinous layer comprises a hardening resin.

10. The electrophotographic photoconductor as claimed in claim 1, wherein said resinous layer comprises a water-soluble resin.

11. The electrophotographic photoconductor as claimed in claim 1, wherein said resinous layer comprises an alcohol-soluble resin.

12. The electrophotographic photoconductor as claimed in claim 9, wherein said hardening resin is selected from the group consisting of alkyd resin, melamine resin, epoxy resin and urethane resin.

13. The electrophotographic photoconductor as claimed in claim 10, wherein said water-soluble resin is selected from the group consisting of polyvinyl alcoholic and casein.

14. The electrophotographic photoconductor as claimed in claim 11, wherein said alcohol-soluble resin is selected from the group consisting of nylon copolymer and methoxymethylated nylon.

15. The electrophotographic photographic photoconductor as claimed in claim 1, wherein the amount of said salt is in the range of 0.1 to 50 parts by weight to 100 parts by weight of said resin.

16. The electrophotographic photographic photoconductor as claimed in claim 1, wherein said undercoat layer further comprises, as a white pigment, titanium dioxide, zinc sulfide, zinc oxide or white lead.

17. The electrophotographic photographic photoconductor as claimed in claim 1, wherein said carboxylate is a salt of an aromatic hydrocarbon carboxylic acid.

18. The electrophotographic photographic photoconductor as claimed in claim 17, wherein said aromatic hydrocarboxylic acid is selected from the group consisting of salicylic acid, phthalic acid, benzoic acid, pyromellitic acid, p-phenylbenzoic acid, nitrobenzoic acid 1-naphthaleneacetic acid, and 9-anthracenecarboxylic acid.

19. Electrophotographic photographic photoconductor as claimed in claim 1, wherein said carboxylate is a salt of an aliphatic hydrocarbon carboxylic acid.

20. The electrophotographic photographic photoconductor as claimed in claim 19, wherein said aliphatic hydrocarboxylic acid is selected from the group consisting of acetic acid, adipic acid, stearic acid, 2-ethylhexanoic acid, oleic acid, citric acid, crotonic acid, succinic acid, tartaric acid, sebacic acid, n-decanoic acid, pyruvic acid, palmitic acid, fumaric acid, and acetylenedicarboxylic acid.

21. The electrophotographic photographic photoconductor as claimed in claim 1, wherein said amino carboxylate is a salt of an amio carboxylic acid selected from the group consisting of glycine, amino hexanoic acid, aminohipurric acid, glycylglycine, 4-amono salicylic acid, p-amonobenzoic acid, and ethylenediaminetetraacetic acid.

22. The electrophotographic photographic photoconductor as claimed in claim 1, wherein said phosphate is a salt of orthophosphoric acid.

23. The electrophotographic photographic photoconductor as claimed in claim 1, wherein said polyphosphate is a salt of a polyphosphoric acid selected from the group consisting of triphosphoric acid, trimetaphosphoric acid, tetrametaphosphoric acid, metaphosphoric acid, and pyrophosphric acid.

24. The electrophotographic photographic photoconductor as claimed in claim 1, wherein said phosphorate derivative is a salt of a phosphric acid derivative selected from the group consisting of 1-naphthyl-phosphoric acid, and carbamyl phosphate.

25. The electrophotographic photographic photoconductor as claimed in claim 1, wherein said phosphite is a salt of a phosporous acid selected from the group consisting of hypophosphorous acid, orthophophorous acid, metaphophorous acid, and pyrophosphorous acid.

26. The electrophotographic photographic photoconductor as claimed in claim 1, wherein said borate is a salt of boric acid or metaboric acid.

27. The electrophotographic photographic photoconductor as claimed in claim 1, wherein said sulfuate is a salt of a sulfuric acid selected from the group consisting of sulfuric acid, pyrosulfuric acid and thiosulfuric acid.

28. The electrophotographic photographic photoconductor as claimed in claim 1, wherein said sulfuite is a salt of a sulfurous acid selected from the group consisting of sulfurous acid and pyrosulfurous acid.

29. The electrophotographic photographic photoconductor as claimed in claim 1, wherein said binder resin is selected from the group consisting of a water-soluble resin, alcohol-soluble resin and a setting-type resin forming a three-dimensional network.

* * * * *